US006657511B2

(12) United States Patent
Dejima

(10) Patent No.: US 6,657,511 B2
(45) Date of Patent: Dec. 2, 2003

(54) NONRECIPROCAL CIRCUIT DEVICE AND COMMUNICATION APPARATUS INCLUDING THE SAME

(75) Inventor: Hiroki Dejima, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 4 days.

(21) Appl. No.: 09/858,765

(22) Filed: May 16, 2001

(65) Prior Publication Data

US 2002/0030548 A1 Mar. 14, 2002

(30) Foreign Application Priority Data

May 17, 2000 (JP) ..... 2000-145121

(51) Int. Cl.[7] ..... H01P 1/32
(52) U.S. Cl. ..... 333/1.1; 333/24.2
(58) Field of Search ..... 333/1.1, 24.2; H01P 1/36

(56) References Cited

U.S. PATENT DOCUMENTS 6,037,844 A * 3/2000 Makino et al. ..... 333/1.1

FOREIGN PATENT DOCUMENTS

JP 09-116308 A * 5/1997 ..... H01P/1/36
JP 10-200307 7/1998
JP 11-239009 A * 8/1999 ..... H01P/1/383

OTHER PUBLICATIONS

Comprehensive Electronic Parts Handbook, Dempa Publications, Inc., Jul. 30, 1980, Publication 2, p. 731.

JIS Handbook 23, Electronic Parts III (Parts), Japanese Standards Association, Mar. 25, 2002, Publication 33, pp. 695–696.

JIS Handbook OJIS Comprehensive List, Japanese Standards Association, Jan. 31, 2002, Publication 4.

* cited by examiner

*Primary Examiner*—Robert Pascal
*Assistant Examiner*—Stephen E. Jones
(74) *Attorney, Agent, or Firm*—Keating & Bennett, LLP

(57) ABSTRACT

A nonreciprocal circuit device as a lumped-constant isolator includes a metal lower case portion, a resin terminal case, a central electrode assembly, a metal upper case portion, a permanent magnet, an insulating spacer, a resistor element, and matching capacitors. The thickness of the resistor element is not less than 0.1 mm and not greater than 0.5 mm.

4 Claims, 5 Drawing Sheets

NONRECIPROCAL CIRCUIT DEVICE AND COMMUNICATION APPARATUS INCLUDING THE SAME

BACKGROUND OF THE INVENTION

1. Field of the Invention

The present invention relates to nonreciprocal circuit devices, and in particular, to a nonreciprocal circuit device such as an isolator or a circulator for use in microwave bonds, and a communication apparatus including the nonreciprocal circuit device.

2. Description of the Related Art

In general, a lumped-constant isolator for use in a mobile communication apparatus such as a mobile phone has a function of allowing signals to pass only in a transmission direction so that a reverse transmission of the signals is prevented. As for conventional mobile communication apparatuses, a reduction in thickness and weight is in great demand, due to their uses.

A lumped-constant isolator of the above type includes a permanent magnet, a ferrite member to which a direct current magnetic field is applied by the permanent magnet, a plurality of central electrodes arranged on the ferrite member, a resistor element, a resin case for accommodating the ferrite member, the central electrodes, and the resistor element, and a metal case for accommodating the permanent magnet, the ferrite member, and the central electrodes.

In general, an isolator is often formed such that a permanent magnet is provided to cover the entire surfaces of a ferrite member and a resistor element so that the isolator exhibits its performance to the maximum. In the case of a conventional isolator, the upper surface of a resistor element provided in a resin case is above the upper surface of an insulating spacer on a ferrite member and a matching capacitor. Thus, the total of the thicknesses of the permanent magnet and the resistor element determines the overall height of the isolator.

In actuality, in accordance with the total of the thicknesses or the resistor element and the permanent magnet, by increasing the thickness of the insulating spacer to be more than a value that is essentially required, the upper surface of the insulating spacer is level with the height of the resistor element. This is because the permanent magnet is stably and horizontally disposed in the isolator. Here, it is possible that the thickness of the permanent magnet be reduced. This causes a problem in that the magnitude of a direct current magnetic field which is applied to the ferrite member is insufficient, so that a reduction in thickness is difficult.

SUMMARY OF THE INVENTION

Accordingly, it is an object of the present invention to provide a nonreciprocal circuit device having a height reduced without reducing the thickness or a permanent magnet, and a communication apparatus including the nonreciprocal circuit device.

To this end, according to an aspect of the present invention, the foregoing object is achieved through provision of a nonreciprocal circuit device including a permanent magnet; a ferrite member to which a direct current magnetic field is applied by the permanent magnet, said ferrite member including a plurality of central electrodes; a resistor element which has a thickness of not less than 0.1 mm and not greater than 0.5 mm and in which a resistor is provided between lead electrodes formed on two ends of a main surface of a substrate; a resin case for accommodating the ferrite member, the central electrodes, and the resistor element; and a metal case for accommodating the permanent magnet, the ferrite member, and the central electrodes.

The above-described construction enables a nonreciprocal circuit device to have a low height without reducing the thickness of the permanent magnet.

By allowing the lead electrodes in the resistor element to extend on two sides of the substrate or to extend to the other main surface of the substrate via the two sides, an area of contact between the lead electrodes in the resistor element and terminals provided on the resin case is increased. This increases the strength of bonding by solder or the like, and reliability is enhanced.

According to another aspect of the present invention, a communication apparatus includes a nonreciprocal circuit device having the above-described characteristics, whereby the thickness of the communication apparatus is reduced. This provides high reliability.

Since the thickness of a resistor element is reduced to not less than 0.1 mm and not greater than 0.5 mm, the height of a nonreciprocal circuit device can be reduced without reducing the thickness of a permanent magnet. In addition, since lead electrodes in the resistor element are provided to extend on two sides of one main surface of a substrate or to extend to the other main surface of the substrate via the two sides, an area of contact between the lead electrodes in the resistor element and terminals provided on the resin case is increased. Accordingly the strength of bonding by solder or the like can be increased enhancing reliability. As a result, a highly reliable thin nonreciprocal circuit device and a communication apparatus having the nonreciprocal circuit device are obtained.

DESCRIPTION OF THE PREFERRED EMBODIMENTS

A nonreciprocal circuit device and a communication apparatus according to embodiments of the present invention are described below with reference to the accompanying drawings.

Figure 1:
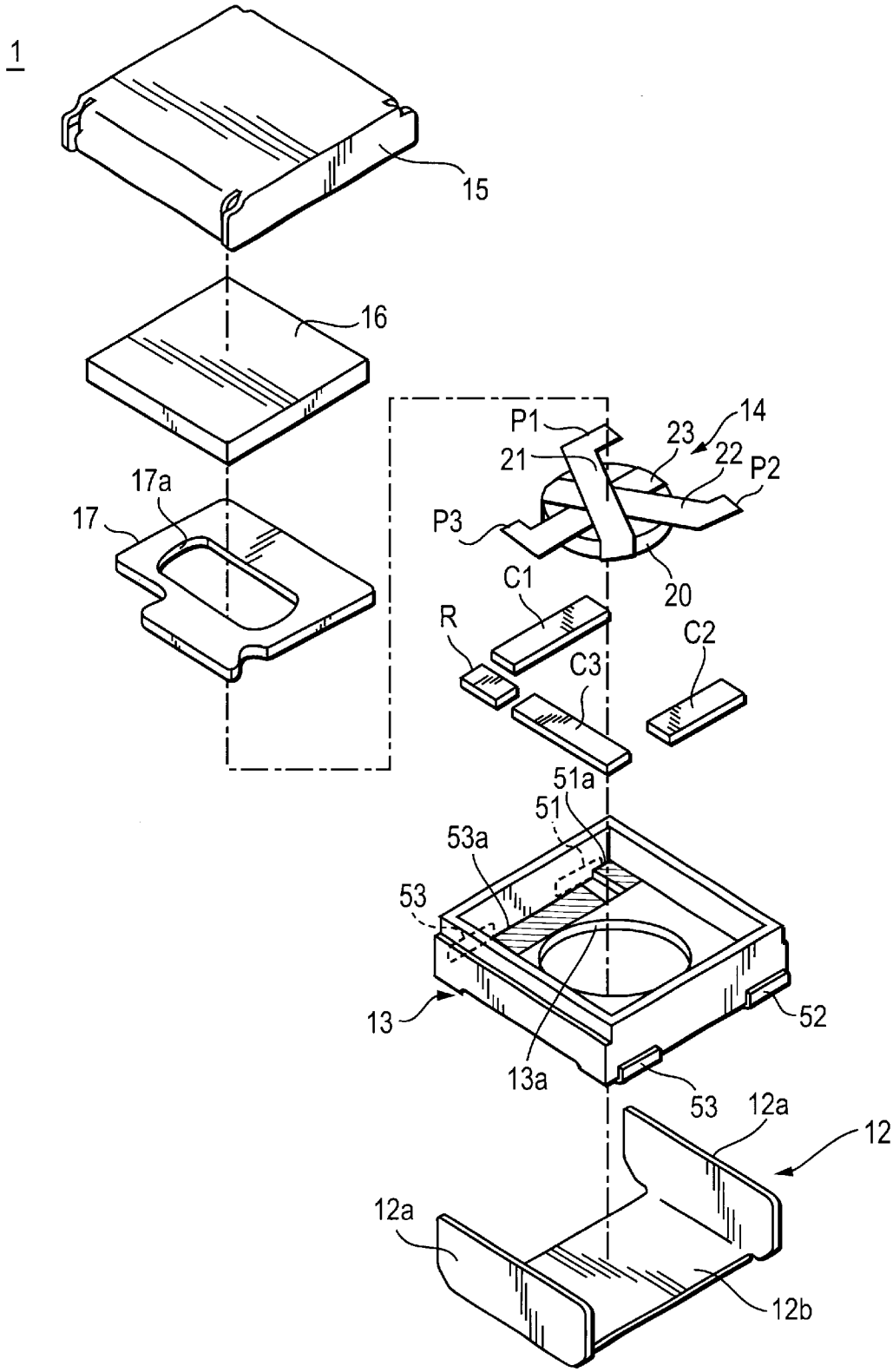
FIG. 1 is a perspective exploded view showing a nonreciprocal circuit device according to a first embodiment of the present invention.
Figure 2:
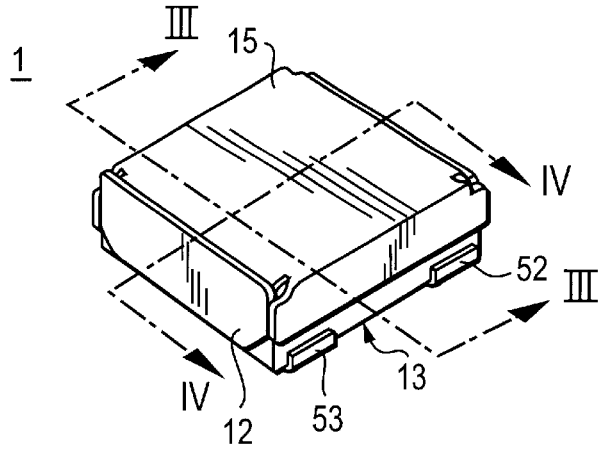
FIG. 2 is a perspective exterior view showing the nonreciprocal circuit device shown in FIG. 1 in an assembled state.
Figure 3:
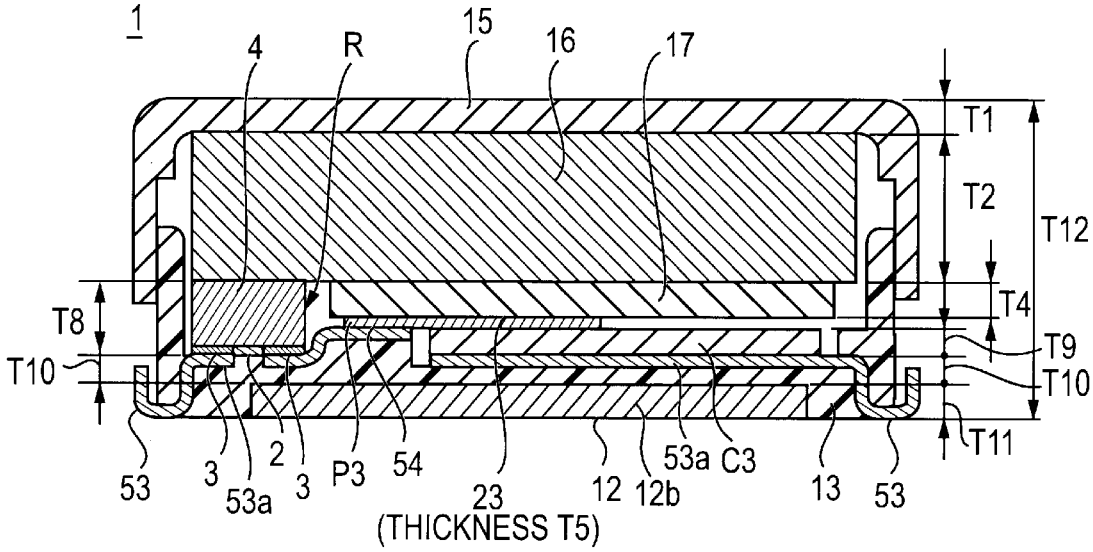
FIG. 3 is a sectional view taken on the line III—III shown in FIG. 2.
Figure 4:
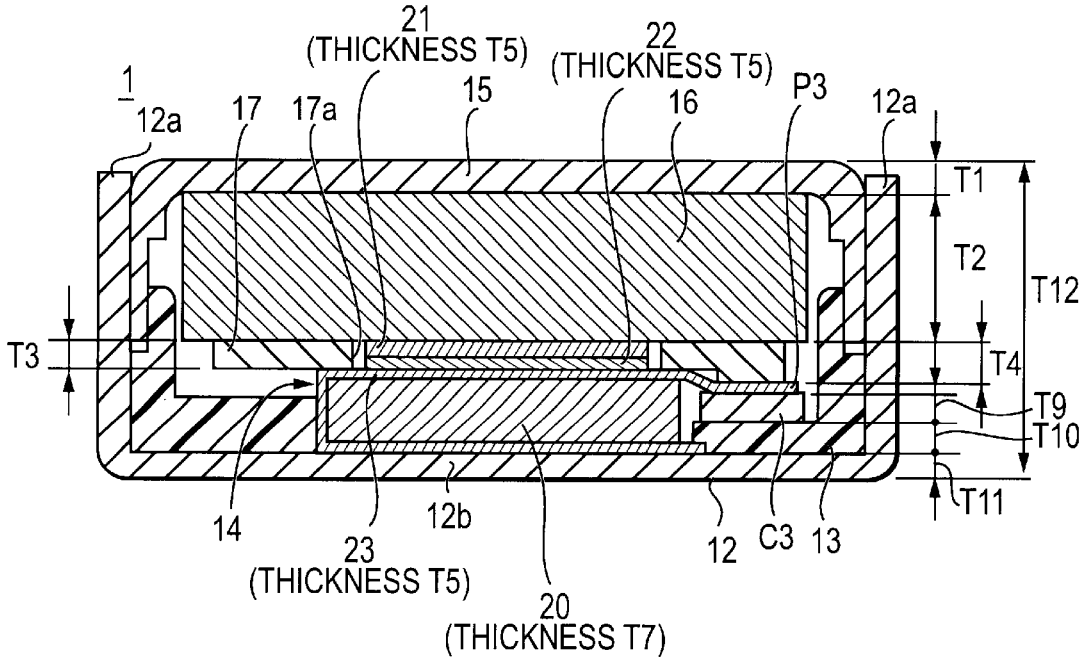
FIG. 4 is a sectional view taken on the line IV—IV shown in FIG. 2.

FIG. 1 is a perspective exploded view of a nonreciprocal circuit device 1 according to an embodiment of the present invention. FIG. 2 is a perspective view of the nonreciprocal circuit device 1 in FIG. 1 in an assembled state. FIG. 3 is a sectional view taken along the line III—III in FIG. 2. FIG. 4 is a sectional view taken along the line IV—IV in FIG. 2. The nonreciprocal circuit device 1 is a lumped constant isolator.

As shown in FIG. 1, the nonreciprocal circuit device 1 as a lumped-constant isolator schematically includes a metal lower case portion 12, a resin terminal case 13, a central electrode assembly 14, a metal upper case portion 15, a permanent magnet 16, an insulating spacer 17, a resistor element R, and matching capacitors C1 to C3.

The central electrode assembly 14 is formed such that central electrodes 21 to 23 are arranged on the upper surface (one magnetic pole surface) of a circular microwave ferrite member 20 so as to cross at each angle of approximately 120 degrees with respect to each other, with the central electrodes 21 to 23 electrically insulated from each other. In the center of the upper surface of the ferrite member 20, the central electrodes 21 to 23 and three insulating sheets are stacked. In the periphery of the ferrite member 20, the central electrodes 21 to 23 are separately arranged.

Ports P1 to P3 at one end of the central electrodes 21 to 23 are arranged horizontally to the central electrodes 21 to 23. The central electrodes 21 to 23 form a common shielding portion at the other end thereof which abuts on the lower surface (the other magnetic poles surface) of the ferrite member 20. The common shielding portion covers substantially all of the lower surface of the ferrite member 20, and is connected to a bottom wall 12*b* of the metal lower case portion 12 through an aperture portion 13*a* of the resin terminal case 13 by a technique such as soldering so as to be grounded. In the first embodiment, the ferrite member 20 has a thickness T4 of 0.45 mm, each of the central electrodes 21 to 23 has a thickness T5 of 0.05 mm, and the central electrodes 21 to 23 and the three insulating sheets have a total thickness of 0.2 mm. Thus, the central electrode assembly 14 has a thickness of 0.7 mm.

The resin terminal case 13 is insert-molder so that input/output terminals 51 and 52, ground terminals 53, and a relay terminal 54 (see FIG. 3) are provided. One end of the input/output terminal 51 is exposed from the outer wall of the resin terminal case 13, and the other end of the input/output terminal 51 is exposed from the inner surface of the resin terminal case 13, so that an input/output lead electrode portion 51*a* is formed. One end of the input/output terminal 52 is exposed from the outer wall of the resin terminal case 13, and the other end of the input/output terminal 52 is exposed from the inner surface of the resin terminal case 13, so that an input/output lead electrode portion (not shown) is formed. Similarly, respective ends of the two ground terminals 53 are exposed from opposing outer walls of the resin terminal case 13, and the other ends of the ground terminals 53 are exposed from the inner surface of the resin terminal case 13, so that ground lead electrode portions 53*a* are formed. In the case of the first embodiment, the thickness T10 of a portion of the resin terminal case 13 in which the matching capacitors C1 to C3 are provided is 0.2 mm, including the thickness of each terminal 53.

The hot-side capacitor electrodes of the matching capacitors C1 to C3 (capacitors each having a relative dielectric constant $\epsilon_r$ of 9 to 200 are used based on the operating frequency of the lumped-constant isolator 1) are respectively connected to the ports P1 to P3 by soldering, and the cold-side capacitor electrodes of the matching capacitors C1 to C3 are respectively connected by soldering to the ground lead electrode portions 53*a* of the ground terminals 53, which are exposed from the inner surface of the resin terminal case 13. In the case of the first embodiment, the thickness T9 of each of the matching capacitors C1 to C3 is 0.2 mm.

As shown in FIG. 3, the resistor element R is formed such that lead electrodes 3 are formed on two ends of a main surface of the insulating substrate 4 by thick-layer printing or the like, and a resistor 2 of a metal thin film or of a thick film made of cermet-based, carbon-based, or ruthenium-based material is provided between the lead electrodes 3. For example, a dielectric ceramic such as alumina is used as material for the insulating substrate 4. The surface of the resistor 2 may be coated with glass or the like. The thickness T8 of the resistor element R is set to not less than 1.0 mm and not more than 0.5 mm. In the case of the first embodiment, the thickness T8 of the resistor element R is substantially 0.5 mm. The resistor element R is disposed with the resistor 2 and the lead electrodes 3 facing downward such that the lead electrodes 3 are electrically connected to the ground lead electrode portions 53 exposed from the inner surface of the resin terminal case 13 and the relay terminal 54, respectively.

One end of the lead electrode 3 of the resistor element R is connected to the hot-side capacitor electrode of the matching capacitor C3 via the relay terminal 54, and the other end is connected to one ground terminal 53. In other words, the matching capacitor C3 and the resistor element R are electrically connected in parallel to each other between the port P3 of the central electrode 23 and the ground.

As shown in FIG. 1, the insulating spacer 17 is arranged on an upper surface of the central electrode assembly 14. As shown in FIG. 4, in the insulating spacer 17 is formed a hole 17*a* for accommodating the central electrodes 21 to 23 and the three insulating sheets, which overlap in the center of the upper surface of the ferrite member 20. The thickness or the insulating spacer 17 differs depending on portions thereof. In the case of the first embodiment, the thickness T3 of the insulating spacer 17 arranged on the ferrite member 20 is 0.15 mm, and a thickness T4 thereof arranged on the capacitors C1 to C3 is 0.25 mm.

The metal lower case portion 12 is made of magnetic metal, and has right and left sidewalls 12*a* and a bottom wall 12*b*. The resin terminal case 13 is provided on the metal lower case portion 12. In the resin terminal case 13, the central electrode assembly 14, the matching capacitors C1 to C3, etc., are accommodated, and the metal upper case portion 15, which is made of magnetic metal, is provided. The permanent magnet 16 is bonded to a lower surface of the metal upper case portion 15, and is used to apply a direct current magnetic field to the central electrode assembly 14. The metal lower case portion 12 and the metal upper case portion 15 constitute a magnetic circuit, and function as a yoke. Each of the metal lower case portion 12 and the metal upper case portion 15 is obtained by stamping a predetermined shape from a sheet material exhibiting high permeability such as iron or silicon steel, bending it, and plating its surface with copper or silver. In the first embodiment, the thickness T11 of the metal lower case portion 12 is 0.2 mm, the thickness T1 of the metal upper case portion 15 is 0.25 mm, and the thickness T2 of the permanent magnet 16 is 1.0 mm.

Figure 5:
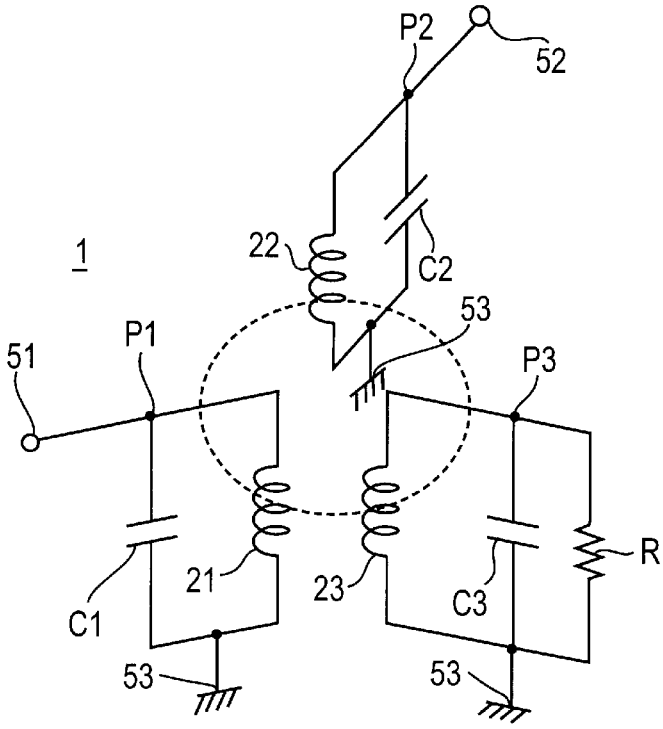
FIG. 5 is an electrically equivalent circuit diagram of the nonreciprocal circuit device shown in FIG. 2.

In the above manner, the lumped constant isolator 1 is obtained. FIG. 5 is an electrically equivalent circuit diagram of the lumped-constant isolator 1.

The following table shows the thicknesses T1 to T11 of the components of the lumped-constant isolator 1 and its overall thickness T12. For comparison, values of a conventional isolator are also shown.

[unit: mm]

| | First embodiment | Conventional example |
|---|---|---|
| Thickness T1 of upper case portion 15 | 0.250 | 0.250 |
| Thickness T2 of permanent magnet 16 | 1.000 | 1.000 |
| Thickness of insulating spacer 17 | | |
| (portions above ferrite member) T3 | 0.150 | 0.280 |
| (portions above capacitor) T4 | 0.250 | 0.380 |
| Thickness T5 of each of central electrodes 21 to 23 | 0.050 | 0.050 |
| Total thickness T6 of central electrodes 21 to 23 and three insulating sheets | 0.200 | 0.200 |
| Thickness T7 of ferrite member 20 | 0.450 | 0.450 |
| Thickness T8 of resistor element R | 0.500 | 0.680 |
| Thickness T9 of each of capacitors C1 to C3 | 0.200 | 0.200 |
| Thickness T10 of resin terminal case 13 (including terminal 53) | 0.200 | 0.200 |
| Thickness T11 of lower case portion 12 | 0.200 | 0.200 |
| Total thickness T12 of the isolator 1 | 2.150 | 2.280 |

In FIG. 4, the thickness T3 of the insulating spacer 17 (above the ferrite member 20) must be 0.15 mm or greater that is obtained by adding each thickness T5 (=0.05 mm) of the central electrodes 21 and 22, and a total the thicknesses (=0.05 mm) of the three insulating sheets. In addition, the thickness of the insulating spacer 17 is determined so as to flatten a difference in level which is caused by stacking the central electrodes 21 to 23 and the insulating sheets. Accordingly, the thickness T3 of the insulating spacer 17 (above the ferrite member 20) may be 0.15 mm from the point of view of reduction in the height of the lumped-constant isolator 1.

Therefore, a distance from the lower surface of the permanent magnet 16 which corresponds to the ferrite member 20 to the bottom surface of the lumped-constant isolator 1 is calculated by the following expression:

"Thickness T11 of the metal lower case portion 12"+

"Thickness of the common shielding portion of the central electrodes 21 to 23"+

"Thickness T7 of the ferrite member 20"+

"Thickness T5 of the central electrode 23"+

"Thickness T3 of the insulating spacer 17 above the ferrite member 20"=

0.2 mm+0.05 mm+0.45 mm+0.05 mm+0.15 mm=0.9 mm (1)

In FIG. 3, a distance from the lower surface of the resistor element R to the bottom surface of the lumped-constant isolator 1 is calculated by the following expression:

"Thickness T11 of Metal Lower Case Portion 12"+

"Thickness T10 of Portion of Resin Terminal Case 13 in which Matching Capacitor C3 is provided"+

"Thickness T10 or a portion of the resin terminal case 13 in which the matching capacitor C3 is provided"=0.2 mm+0.2 mm=0.4 mm (2)

Thus, the maximum thickness T8 of the resistor element R is 0.9 mm−0.4 mm=0.5 mm from expression (1)–expression (2).

When the thickness T8 of the resistor element R exceeds 0.5 mm, a total thickness from the lower surface of the permanent magnet 16 to the bottom surface of the lumped-constant isolator 16 is greater than 0.9 mm, so that the thickness of the lumped-constant isolator 1 is increased. In this case, it is considered that the thickness of the permanent magnet 16 should be reduced. However, this makes it impossible to apply a sufficient direct current magnetic field to the ferrite member 20. Accordingly, the thickness T2 of the permanent magnet 16 cannot be reduced. Thus, from the point of view of reduction in the height of the lumped-constant isolator 1, the upper limit of the thickness T8 of the resistor element R is 0.5 mm. In addition, stress such as thermal stress acts on the resistor element R when it is soldered to the terminals 53 and 54. It is required that resistor element R have a thickness not less than a certain value in order that the resistor element R may resist to pressure generated when the resistor element R is formed by printing, thermal stress generated when the resistor element R is fired, and pressure applied when the lumped-constant isolator 1 is assembled. Accordingly, from the standpoints of reliability, processability, and easiness of assembling process, the lower limit of the thickness of the resistor element R is 0.1 mm.

As shown in FIG. 3, the resistor element R and the matching capacitors C1 to C3 are disposed at the same level in the resin terminal case 13 (i.e., the level of a surface on which the terminals 51 to 54 are exposed). In the lumped-constant isolator 1, the permanent magnet 16 is stabily and horizontally disposed by setting, with respect to the thickness T8 (=0.5 mm) of the resistor element R, the thickness of a portion in which the matching capacitor C3 (C1, C2) to "Thickness T9 of the matching capacitor C3"+"Thickness T5 of the central electrode 23"+"Thickness T4 of the insulating spacer 17 above the matching capacitor C3"=0.2 mm+0.05 mm+0.25 mm=0.5 mm.

As a result, the overall thickness T12 of the lumped-constant isolator 1 according to the first embodiment is calculated, for example, by the following expression:

"Thickness T11 of the metal lower case portion 12"+

"Thickness T10 of the resin terminal case 13"+

"Thickness T8 of the resistor element R"+

"Thickness T2 of the permanent magnet 16"+

"Thickness T1 of the metal upper case portion 15"=0.2 mm+0.2 mm+0.5 mm+1.0 mm+0.25 mm=2.15 mm (3)

The overall thickness of the conventional isolator is 2.28 mm as a result of calculation similar to the expression (3).

As described above, the height of the lumped-constant isolator 1 according to the first embodiment can be reduced without reducing the thickness of the permanent magnet 16.

Figure 6:
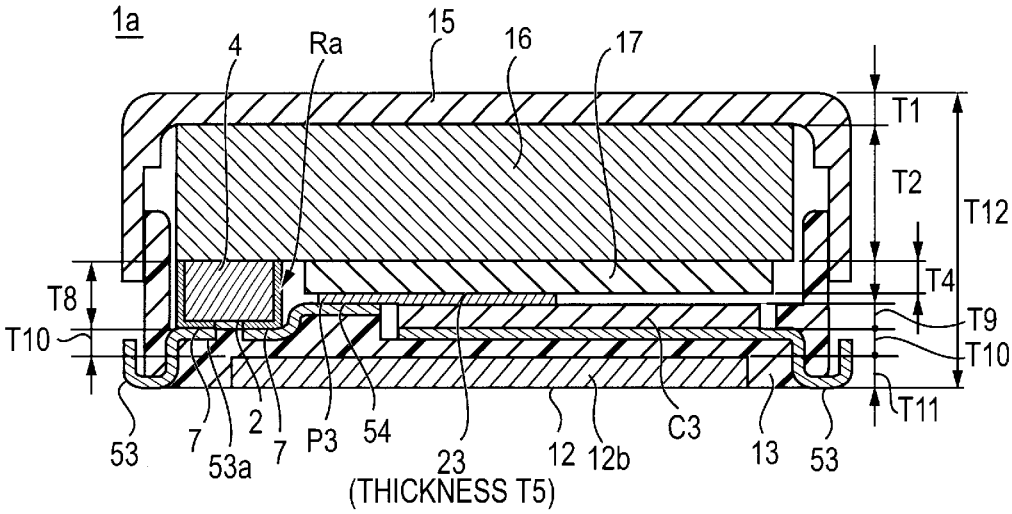
FIG. 6 is a sectional view showing a nonreciprocal circuit device according to a second embodiment of the present invention.

Referring to FIG. 6, a lumped-constant isolator 1*a* according to a second embodiment of the present invention is obtained such that in the first embodiment, a resistor element Ra is used instead of the resistor element R. The resistor element Ra is configured such that a resistor 2 is provided between lead electrodes 7 formed so as to extend on two ends of a main surface of the insulating substrate 4 and on sides of the insulating substrate 4. In the second embodiment, the resistor element Ra is provided with the resistor 2 facing downward, similarly to the resistor element R in the first embodiment.

Because the lead electrodes 7 extend on the sides of the insulating substrate 4, the resistor element Ra has a large area of connection between the lead electrodes 7 and terminals 53 and 54, and a solder filet is formed. Accordingly, the soldering strength increases and the reliability improves.

Figure 7:
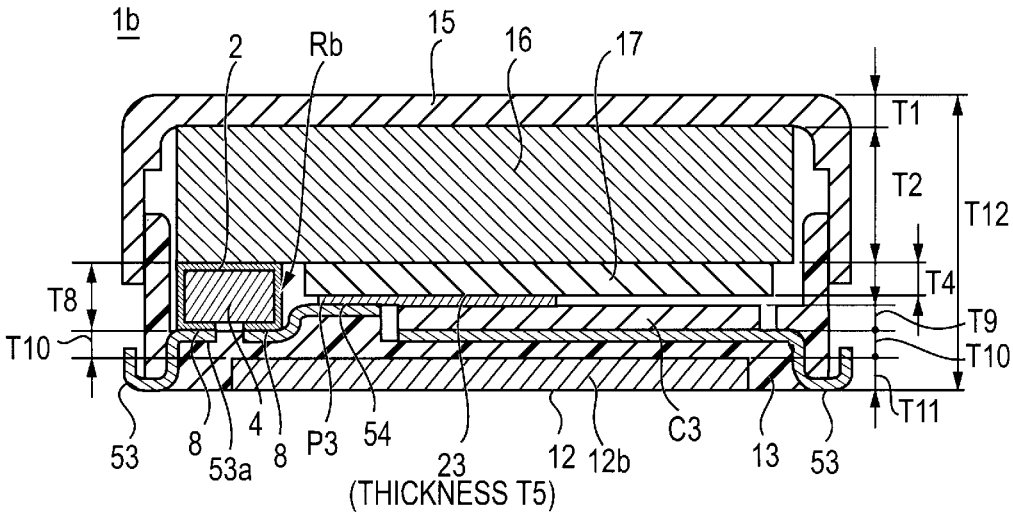
FIG. 7 is a sectional view showing a nonreciprocal circuit device according to a third embodiment of the present invention.

Referring to FIG. 7, a lumped-constant isolator 1*b* according to a third embodiment of the present invention is obtained such that a resistor element Rb is used instead of the resistor element R in the first embodiment. The resistor element Rb is formed such that a resistor 2 is provided between lead electrodes 8 so as to extend from two ends of one main surface of the insulating substrate 4 to the other main surface opposite to the main surface. In the third embodiment, the resistor element Rb is provided with the resistor 2 facing upward, in reverse to a case where the resistor R is provided in the first embodiment.

Because the load electrodes 8 extend to the other main surface via the sides of the insulating substrate 4, the resistor element Rb has as large area of connection between the lead electrodes 8 and the terminals 53 and 54, and a solder filet is formed. Accordingly, the soldering strength increases and the reliability improves.

A mobile phone 120 as a communication apparatus according to a fourth embodiment of the present invention is described below with reference to FIG. 8.

Figure 8:
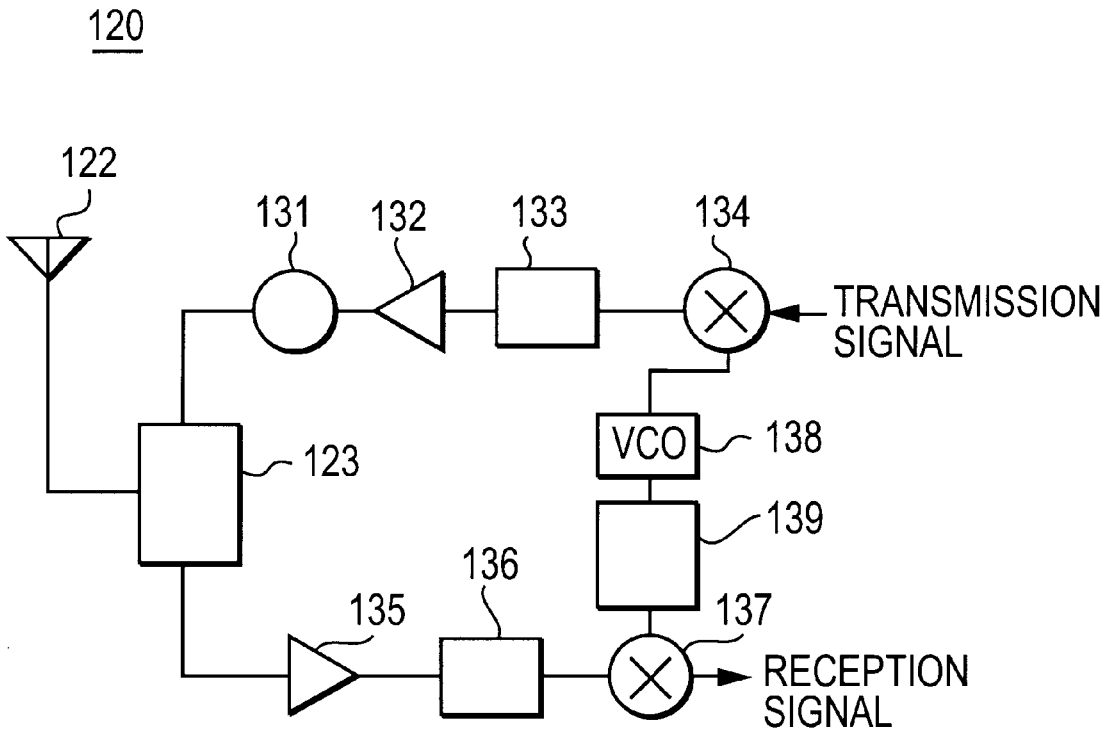
FIG. 8 is a block diagram showing a communication apparatus according to a fourth embodiment of the present invention.

FIG. 8 is an electric circuit block diagram showing the RF part of the mobile phone 120 in FIG. 8. The RF part includes an antenna device 122, a duplexer 123, a transmitting isolator 131, a transmitting amplifier 132, a transmitting interstage band-pass filter 133, a transmitting mixer 134, a receiving amplifier 135, a receiving interstage band-pass filter 136, a receiving mixer 137, a voltage-controlled oscillator (VCO) 138, and a local band-pass filter 139.

Each of the lumped-constant isolators 1 to 1*b* according to the first to third embodiments may be used as the transmitting isolator 131. By mounting each of the lumped-constant isolators 1 to 1*b*, a thin mobile phone having suppressed insertion loss and high reliability is achieved.

A lumped-constant isolator and a communication apparatus of the present invention are not limited to the foregoing embodiments, but may be variously modified within the gist of the present invention.

By way of example, in the resistor elements Rd and Rb shown in FIGS. 6 and 7, the lead electrodes 7 and 8 do not need to be provided on both ends. On either end, the lead electrode 3 of the resistor element R shown in FIG. 3 may be used.

The present invention can be applied not only to isolators to which a three-port isolator is applied, but also to isolators in which a resistor is connected to a gyrator having two central electrodes. In the present invention, the central electrodes can be formed not only by stamping a predetermined shape from a metal sheet and bending it, but also by providing a pattern electrode on a substrate such as a dielectric substrate, a magnetic substrate, or a laminated substrate. The three central electrodes do not always need to be arranged so as to cross at 120 degrees with respect to one another, but may be arranged so as to cross at an angle of 110 to 140 degrees with respect to one another. The metal case does not need to be divided as in the foregoing embodiments. The metal case may be divided into three or more portions.

What is claimed is:

1. A nonreciprocal circuit device comprising:

a permanent magnet;

a ferrite member to which a direct current magnetic field is applied by said permanent magnet, said ferrite member including a plurality of central electrodes;

an insulating spacer provided between said permanent magnet and said ferrite member, said insulating spacer having a hole provided therein;

a resistor element which has a thickness of not less than 0.1 mm and not greater than 0.5 mm and in which a resistor is provided between lead electrodes formed on two ends of a main surface of a substrate;

a resin case for accommodating said ferrite member, the central electrodes, and said resistor element; and a metal case for accommodating said permanent magnet, said ferrite member, and the central electrodes; wherein said insulating spacer includes a portion arranged on said ferrite member which is thinner than a portion of said insulating spacer arranged on capacitors of the nonreciprocal circuit device.

2. A nonreciprocal circuit device according to claim 1, wherein in said resistor element, said lead electrodes extend to two sides of said substrate.

3. A nonreciprocal circuit device according to claim 1, wherein in said resistor element, said lead electrodes extend to the other main surface of said substrate via two sides of said substrate.

4. A communication apparatus including a nonreciprocal circuit device according to one of claims 1 to 3.

* * * * *